US005810076A

United States Patent [19]

Harkins et al.

[11] Patent Number: 5,810,076

[45] Date of Patent: Sep. 22, 1998

[54] HIGH PRESSURE CERAMIC HEAT EXCHANGER

[75] Inventors: Bruce D. Harkins, San Diego; Michael E. Ward, Poway, both of Calif.

[73] Assignee: Solar Turbines Incorporated, San Diego, Calif.

[21] Appl. No.: 611,868

[22] Filed: Mar. 6, 1996

[51] Int. Cl.[6] ..... F28F 9/02

[52] U.S. Cl. ..... 165/134.1; 165/135; 165/142; 165/158

[58] Field of Search ..... 165/134.1, 135, 165/142, 81, 158

[56] References Cited

U.S. PATENT DOCUMENTS

| | | | |
|---|---|---|---|
| 4,148,356 | 4/1979 | Cramer | 165/111 |
| 4,269,266 | 5/1981 | Coates, Jr. et al. | 165/142 |
| 4,647,436 | 3/1987 | Herbort et al. | 422/197 |
| 4,740,357 | 4/1988 | Buswell et al. | 422/197 |
| 4,889,182 | 12/1989 | Kosters | 165/134.1 |
| 4,928,754 | 5/1990 | Westerberg | 165/134.1 |

*Primary Examiner*—Allen J. Flanigan

*Attorney, Agent, or Firm*—Larry G. Cain

[57] ABSTRACT

Many recuperators have components which react to corrosive gases and are used in applications where the donor fluid includes highly corrosive gases. These recuperators have suffered reduced life, increased service or maintenance, and resulted in increased cost. The present header assembly when used with recuperators reduces the brittle effect of a portion of the ceramic components. Thus, the present header assembly used with the present recuperator increases the life, reduces the service and maintenance, and reduces the increased cost associated with corrosive action of components used to manufacture recuperators. The present header assembly is comprised of a first ceramic member, a second ceramic member, a strengthening reinforcing member being in spaced relationship to the first ceramic member and the second ceramic member. The header assembly is further comprised of a refractory material disposed in contacting relationship with the first ceramic member, the second ceramic member and the strengthening reinforcing member. The present header assembly provides a high strength load bearing header assembly having good thermal cycling characteristics, good resistance to a corrosive environment and good steady state strength at elevated temperatures.

27 Claims, 4 Drawing Sheets

HIGH PRESSURE CERAMIC HEAT EXCHANGER

"The Government has the rights in this invention pursuant to Contract No. DE-FC02-88ID12799 awarded by the U.S. Department of Energy."

TECHNICAL FIELD

This invention relates generally to a ceramic joint construction utilized in a recuperator or heat exchanger tube assembly and more particularly to strengthening of a refractory used within the joint.

BACKGROUND ART

Present day recuperators and heat exchangers typically used a combination of metal component and ceramic components which must be bonded together. When using dissimilar materials, the joint therebetween is difficult to form, and the use of metal components has several major drawbacks. For example, metal components used in the recuperator or heat exchanger are susceptible to high temperatures and highly corrosive gases. Thus, the use of ceramic materials within recuperator and heat exchanger application to resist high temperature and high corrosive conditions has become necessary to provide longevity, serviceability and quality for future applications.

Additional problems are encountered in adapting ceramic material to high temperature heat exchangers. One of the biggest problem with present tube-type ceramic recuperators centers around the strength of the refractory used with header joints. Refractory materials are generally brittle. Specifically, composite ceramic-metal heat exchangers have problems attributable to stresses resulting from unlike thermal expansion characteristics of the diverse materials. The stresses can cause structural failure and fluid leakage between the high and low pressure sides of the heat exchanger. Additionally, present ceramic-metal heat exchangers are difficult to service and repair.

The increased use of ceramic materials has further emphasized the need for joining ceramic material to other ceramic materials. U.S. Pat. No. 4,784,313 which issued Nov. 15, 1988, to Jerzy Godziemba-Maliszewski, describes a method for bounding silicon carbide molded parts together or with ceramics or metal parts. The above patent discloses that SiC can be firmly bonded to itself or to molded bodies of other ceramic material or to metal work pieces by the establishment of diffusion-welding condition when a metal alloy layer is interposed between cleaned and polished surfaces.

In U.S. Pat. No. 4,642,864, issued Feb. 17, 1987 to Arthur G. Metcalfe et al., a joint construction for joining ceramic and metallic components for use in a recuperator or heat exchanger tube assembly is disclosed. The joint includes a bonding material cast between a ceramic tube and a metal member. The joint further has a seal member with sufficient ductility within a predetermined thermal operating range which will plastically deform and yet maintain an effective fluid seal between the ceramic and metal members.

In U.S. Pat. No. 5,265,918, issued Nov. 30, 1993 to Michael E. Ward and Bruce D. Harkins, a joint construction for joining ceramic to ceramic components for use in a recuperator or heat exchanger tube assembly is disclosed. The joint includes a refractory material disposed in a groove forming a mechanical locking device. The joint provides a high strength load bearing joint having good thermal cycling characteristics, good resistance to corrosive environment and good steady state strength at elevated temperatures.

The present invention is directed to overcoming one or more of the problems set forth above.

DISCLOSURE OF THE INVENTION

In one aspect of the present invention, a header assembly is comprised of a first ceramic member; a second ceramic member being in spaced relationship to the first ceramic member; a strengthening reinforcement member being positional in spaced relationship to the first ceramic member and the second ceramic member; and a refractory material contacting the first ceramic member, the second ceramic member and the strengthening reinforcement member while maintaining the spaced relationship.

In another aspect of the present invention, a recuperator having a header assembly is comprised of a first ceramic member having an aperture defined therein; a second ceramic member having a tubular construction, the second ceramic member being positioned within the aperture and in spaced relationship thereto; a strengthening reinforcement member positional in spaced relationship to the first ceramic member and the second ceramic member; and a refractory material disposed in contacting relationship with the first ceramic member, the second ceramic member and the strengthening reinforcement member.

BEST MODE FOR CARRYING OUT THE INVENTION

Figure 1:
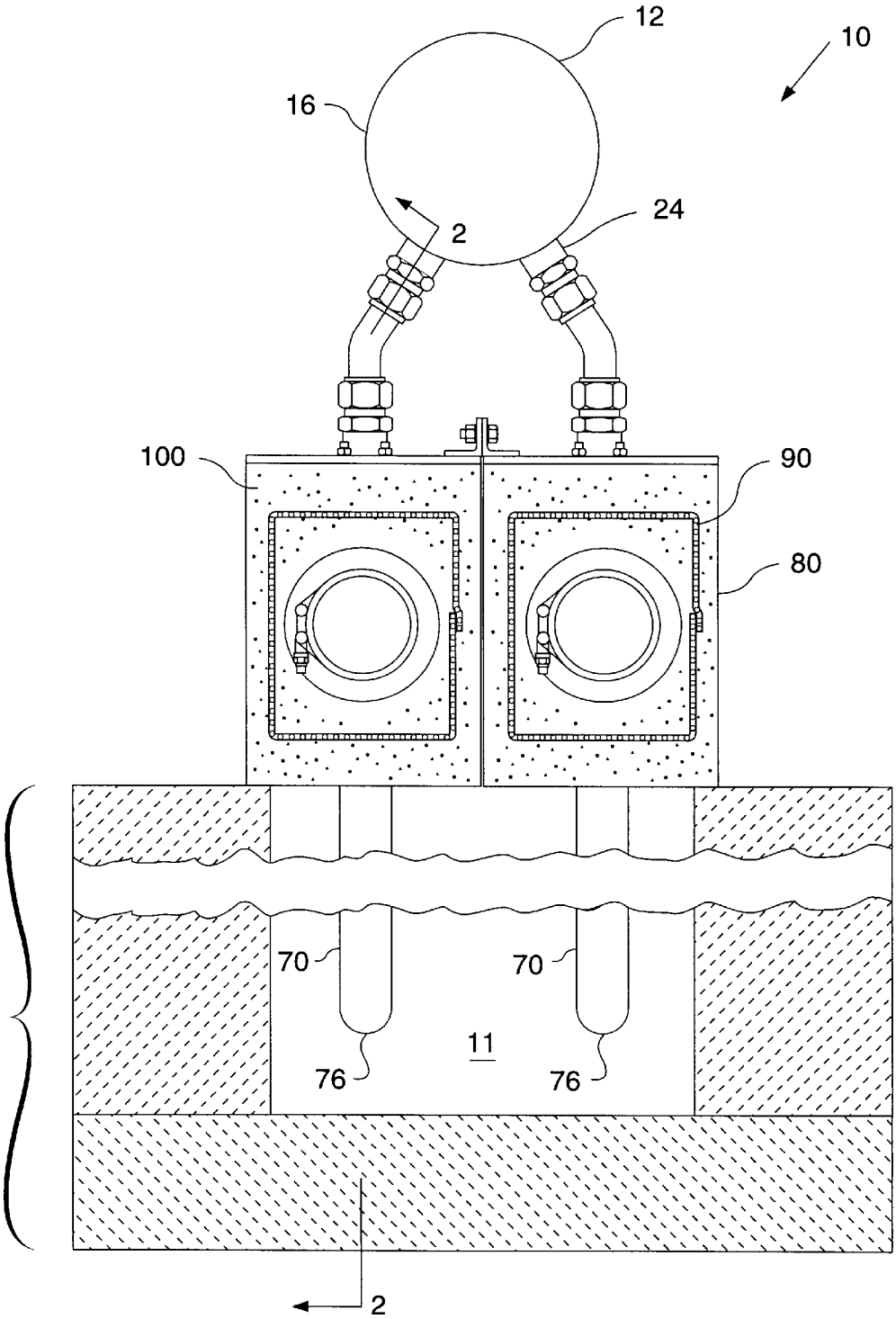
FIG. 1 is a sectional view of a duct and a recuperator embodying the present invention.
Figure 2:
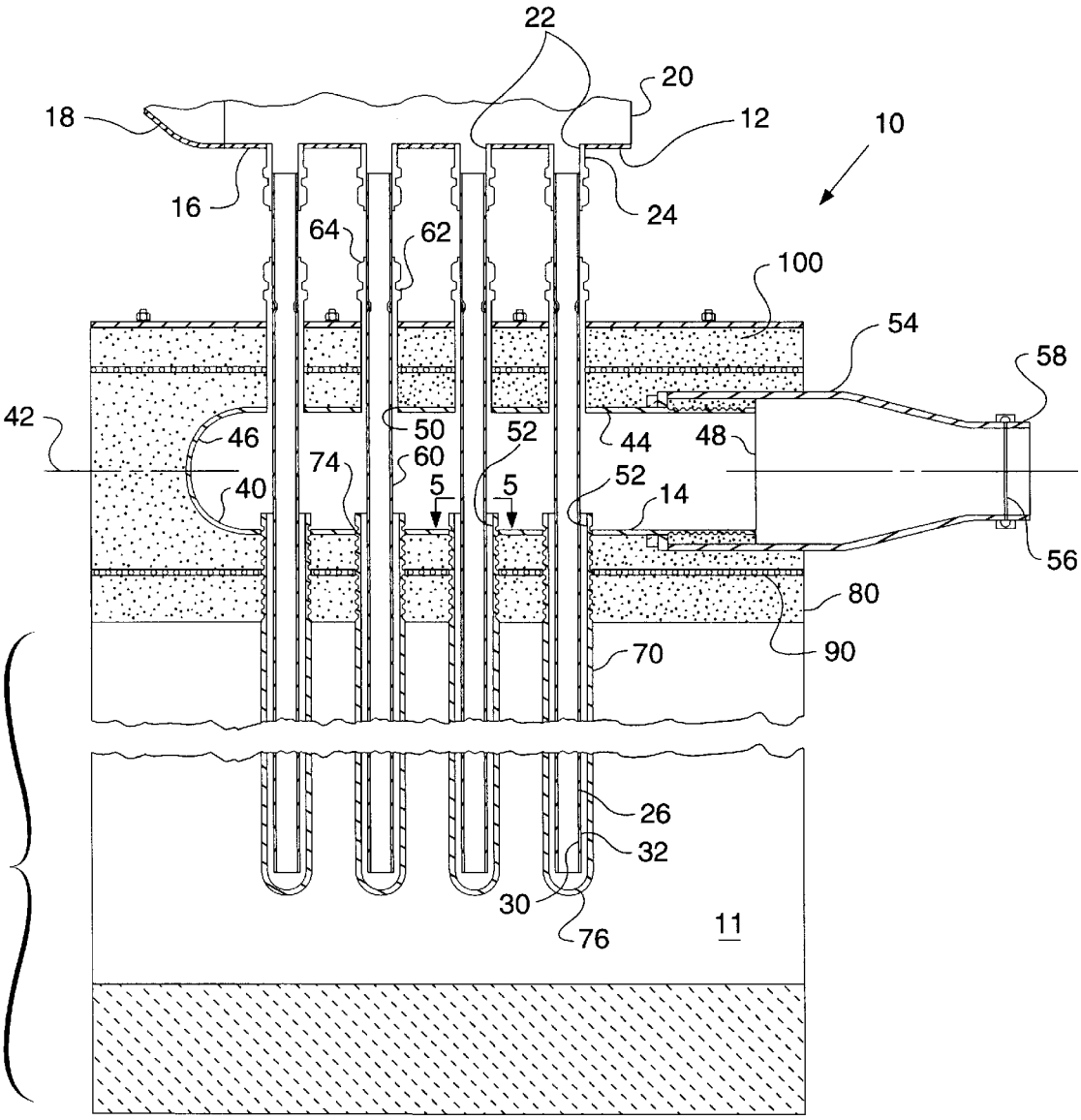
FIG. 2 is an enlarged sectional view of a portion of a fiber reinforced refractory material having a strengthening reinforcement member therein taken along lines 2—2 of FIG. 1.

As best shown in FIGS. 1 and 2, a recuperator or heat exchanger 10 is shown being at least partially positioned within a duct 11. The heat exchanger 10 includes an air inlet manifold 12 and an air outlet manifold 14. The air inlet manifold 12 has a generally cylindrical configuration and is substantially formed by a cylindrical wall 16 having a closed end 18 and an open end 20. The air inlet manifold 12 is made from a metal pipe and the closed end 18 is formed thereon. A plurality of openings 22 are defined in the wall 20 and are axially positioned in preestablished spaced relation one to another. A metallic tube 24 is disposed within each of the plurality of openings 22 and is fixedly attached thereto in a conventional manner. As further shown in FIG. 2, each of the metallic tubes 24 has an extension thereof which is comprised of a wall 26 defined by an outer diameter and an inner diameter. The wall 26 further defines an inner cylindrical surface 30 and an outer cylindrical surface 32. Each of the tubes 24 have opposite ends which are open.

The air outlet manifold 14 includes a ceramic composite member or first ceramic member 40 having a generally cylindrical configuration defining an axis 42. The first ceramic member 40 includes a cylindrical wall member 44 having a closed end 46 and an open end 48. The first ceramic member 40 can be made of a continuous fiber reinforced ceramic composite material of silicon carbide/silicon carbide composite. Nicalon fiber, a silicon carbide is used as the fiber for fabrication of the preform and the matrix deposition process to form the composite material. A plurality of apertures 50 are defined within the cylindrical wall 44 and are axially spaced apart to coincide with the preestablished spaced relationship of the plurality of openings 22 in the air intake manifold 12. A plurality of openings 52 are defined within the cylindrical wall 44 opposite the plurality of apertures 50 and are axial aligned therewith. The open end 48 of the first ceramic member 40 is surrounded by a metallic ring 54 having an attachment flange 56 thereon. The metallic ring 54 is sealingly attached to the first ceramic member 40. The attachment flange 56 has a duct 58 attached thereto to fluidly communicate the heated gaseous fluid away from the heat exchanger 10. A plurality of tubes 60 are sealingly positioned within the apertures 50 and have a threaded end 62 extending beyond the wall member 44. Each of the tubes 60 have a threaded nut 64 having a seal therein, not shown, attached thereto.

A plurality of ceramic tubes or second ceramic members 70 are positioned within the openings 52 defined within the first ceramic member 40. Each tube 70 is positioned within each of the openings 52 in spaced relationship thereto. A sealed joint 74 is formed between the ceramic header 40 and each of the ceramic tubes 70.

Each of the ceramic tubes 70 has a hollow, elongate ceramic tube configuration. Each tube 70 is formed of a ceramic material. Like the first ceramic member 40, each of the tubes 70 is a monolithic silicon carbide structure. As an alternative, the tubes 70 could be made of a particulate reinforced Aluminum Oxide.

As further shown in FIG. 1 and 2, the outer diameter of each metallic tube 24 is less than the inner diameter of each ceramic tube 70. Each of the metallic tubes 24 coaxially extends inside one of the ceramic tube 70 so that the distal end of the metallic tube 24 is near a closed end 76 of the ceramic tube 70. The positioning of each of the plurality of metallic tubes 24 within the plurality of ceramic tubes 70 forms a tube-within-a-tube relationship. The outer surfaces 32 of each of the metallic tubes 24 can be maintained in concentric relationship with the ceramic tube 70 by suitable spacers, not shown.

Figure 3:
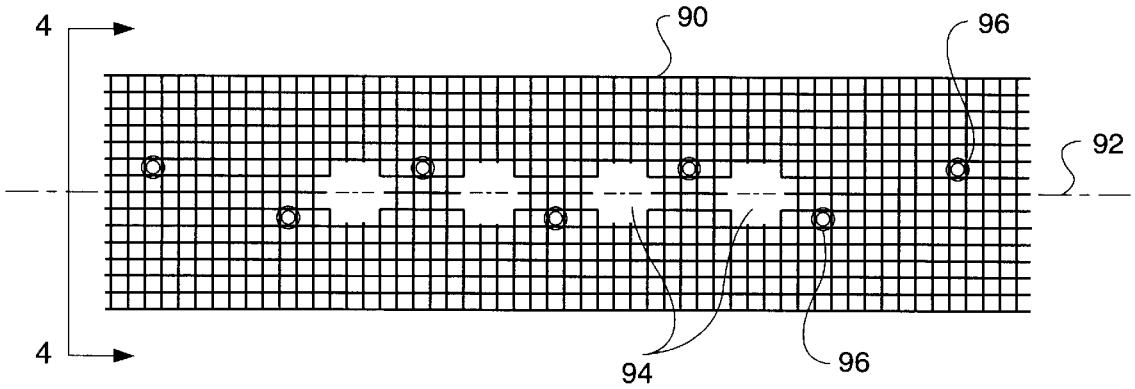
FIG. 3 is an enlarged elevational view of the strengthening reinforcement member.
Figure 4:
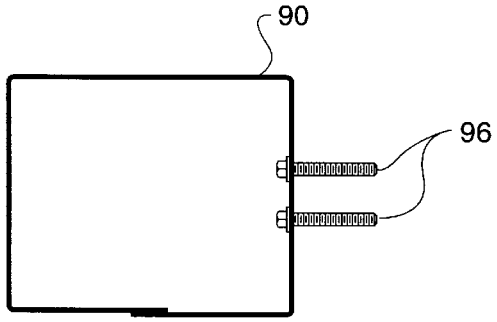
FIG. 4 is an end view of the strengthening reinforcement member.
Figure 5:
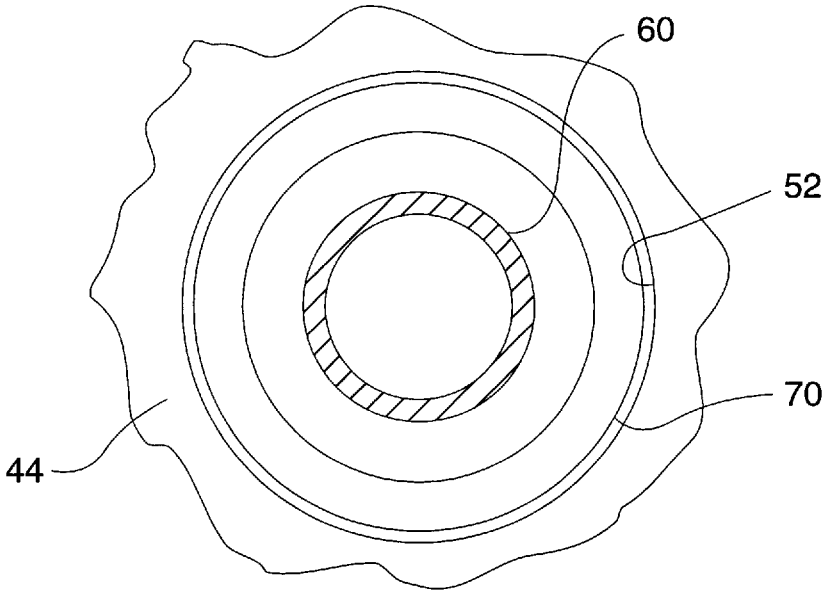
FIG. 5 is and enlarged sectional view taken along line 5—5 of FIG. 2.

A mold or casing, not shown, is used to form a header assembly 80. The mold, in this application, has a generally rectangular configuration, has a plurality of openings defined therein corresponding in position to the plurality of tubes 60 and the ceramic tubes 70 and is positioned about the first ceramic member 40 in spaced relationship thereto forming a void or chamber or cavity therearound. In this application, the spacing around the first ceramic member 40 from the mold is generally uniform or equal. As an alternative, the mold could have a generally square or possibly a cylindrical configuration. Further shown in FIGS. 1, and 2, positioned within the mold and spaced from the mold and the first ceramic member 40 is a strengthening reinforcement member 90. As best shown in FIGS. 3 and 4, the strengthening reinforcement member 90 extends along an axis 92 generally corresponding to the axis 42 of the first ceramic member, is generally rectangular, is spaced from the first ceramic member 40 a preestablished distance and is spaced from the mold a preestablished distance. In this application, the preestablished distance from the first ceramic member 40 and the mold is equal. However, as an alternative, the spacing from the first ceramic member 40 and the mold could be varied without changing the essence of the invention. The strengthening reinforcement member 90 surrounds the first ceramic member 40 and includes a plurality of openings 94 therein positioned in corresponding relationship to the location of the plurality of tubes 60 and the ceramic tubes 70. The plurality of openings 94 are sized to provide clearance between the strengthening reinforcement member 90, and the plurality of tubes 60 and the ceramic tubes 70. To surround the first ceramic member 40, the strengthening reinforcement member 90 is formed from a sheet, bent into the rectangular configuration and has the ends of the sheet overlapping each other at a generally middle point on a side. The overlapping portion of the strengthening reinforcement member 90 is rigidly connected. The strengthening reinforcing member 90 further has a plurality of fasteners 96 attached thereto. The plurality of fasteners 96 are spaced apart along the axis 92 and as is best shown in FIGS. 3 and 4 are alternately offset one from another. In this application, the strengthening reinforcing member 90 is constructed from 3 mm diameter stainless steel wire having a 50 mm×50 mm mesh. As an alternative, the construction of the strengthening reinforcing member 90 could be that of a stainless steel expanded metal flattened mesh. Although the mesh is this application is made of stainless steel other materials such as plastic could be used. The essential characteristics of the strengthening reinforcement member 90 are that a portion of the member 90 should extend substantially the entire axial length of the header assembly 80, surround the ceramic member 40 and provide openings or spaces between the extension such as are formed in a mesh. However, as an alternative, the strengthening reinforcement member 90 could be slightly shorter than the axial length of the header assembly 80 such as by about 12 mm, and may not totally surround the ceramic member 40, such as being of a "U" configuration being void of a complete or closed loop.

A glue or filler, such as epoxy, not shown can be used to position the ceramic tubes 70, the plurality of tubes 60 and the strengthening reinforcing member 90 in spaced relationship to the first ceramic member 40 prior to pouring a refractory material 100 into the chamber. The refractory material 100 is in a slurry form and when poured into the chamber nests around the first ceramic member 40, the plurality of tubes 60, the ceramic tubes 70 and within the mesh of the strengthening reinforcing member 90 filling the chamber without forming voids. In this application, the refractory material is fiber reinforced and attaches to the first ceramic member 40, the plurality of tubes 60, the ceramic tubes 70 and the strengthening reinforcing member 90. The refractory material 100, in this application, is a dense castable material having a composition by weight, of about 70% $Al_2O_3$, 25% $SiO_2$, and 5% trace elements. One such commercially available material is sold by Babcock and Wilcox Co., New York, N.Y., under the trademark name Kaocrete 32-C. This material, as purchased is a mixture of aggregate and fine particles, the fine particles comprise about 60% of the total mixture and are defined as that portion of the mixture that will pass a no. 18 sieve, i.e., a sieve having a nominal opening of about 1.0 mm. The fiber reinforcement use is this application is steel fibers or whiskers which is mixed in the ratio of about 1.4 kgs of fibers to every 45.4 kgs of refractory. However, if corrosion occurs and degradation of strength is determined to be a major problem, the use of high strength alloy fibers can be substituted to reduce the corrosion.

After the refractory material 100 has hardened, the mold is removed and the heat exchanger 10 is assembled and positioned within the conventional furnace or flue gas duct 11.

INDUSTRIAL APPLICABILITY

In application, the recuperator 10 includes the header assembly 80 assembled in the following manner. The metallic tubes 24 are positioned within the respective plurality of openings 22 within the cylindrical wall 16 of the air inlet manifold 12 and are fixedly attached to the wall 16. After assembly, the internal surface of the inlet manifold 12 is coated with the refractory material in a conventional manner. Next, the strengthening reinforcing member 90 is positioned about the first ceramic member 40 and respective tubes 60 are inserted through corresponding ones of the plurality of openings 94 in the strengthening reinforcement member 90 and into corresponding ones of the plurality of apertures 50 in the first ceramic member 40. In addition, respective ceramic tubes 70 are inserted through corresponding ones of the plurality of openings 94 in the strengthening reinforcement member 90 and into corresponding ones of the plurality of openings 52 in the first ceramic member 40. Furthermore, the threaded nut 64 with the seal 66 positioned therein is threadedly engaged onto the threaded end 62 of each of the tubes 60. The assembled nut 64, seal 66, and the tubes 60 are positioned about the outer surface 32 of respective tubes 24 and the nut 64 is tightened on the threaded end 62 and the seal 66 positions the tubes 60 relative to the air inlet manifold 16 and the tubes 24 relative to the ceramic tubes 70. And, the metallic ring 54 is sealingly attached to the first ceramic member 40. Glue can be added to the interface of the tubes 24 and the air inlet manifold 16, the tubes 60 and the first ceramic member 40 and the ceramic tubes 70 and the first ceramic member 40 to maintain the relative position therebetween.

Thus, the header assembly 80 is ready to be formed. The refractory material 100 is ready to be applied to the air outlet manifold 14 fixedly attaching the components one to another. The mold or casing having the openings through which the tubes 24 and the ceramic tubes 70 extend is positioned about the strengthening reinforcement member 90 and the first ceramic member 40 in spaced relationship thereto. The refractory material 100 is poured or cast into the cavity formed by the spaced relationship of the components and the mold. Thus, the fiber reinforced refractory material 100 after drying fixedly attach the components. For example, the castable refractory material 100 flows into the cavity formed by the spaced relationship of the components and the mold, fills the spacing within the mesh of the strengthening reinforcing member 90 and contacts therewith, contacts the cylindrical wall member 44, contacts the tubes 60 and contacts the ceramic tubes 70. Thus, a mechanical joint is formed which provides a high strength load bearing header assembly having good thermal cycling characteristics, good resistance to a corrosive environment and good steady state strength at elevated temperatures.

The strengthening reinforcing member 90 of the present application is used with the recuperator or heat exchanger 10 which is partially disposed within the flue gas duct 11 in a conventional manner of a conventional furnace. During operation of the recuperator 10 within the flue gas duct 11 and the strengthening reinforcing member 90 aid to increase the strength of the header assembly 80 by reducing the effects of the brittleness or the refractory material 100. In operation, high pressure gaseous fluid or recipient fluid, which in this application is air, to be heated, enters the open end 20 of the inlet manifold 12. From the inlet manifold 12, the air passes through the tubes 24 and exits the open end of each of the tubes 24. The air passes along the ceramic tube 70 absorbing heat from the high temperature low pressure gases or donor fluid of combustion passing through the duct 11. The heated air rises between the outer surfaces 32 of the tubes 24 and the ceramic tubes 70 and exits into the air outlet manifold 14. The heated air exits the outlet manifold 14 through the metallic ring 54 and is used in a conventional manner.

The strengthening reinforcing member 90 provides an effective reinforce or bond even through the more brittle refractory material 100 may crack under repeated thermal stress loading. The interlaced characteristics of the mesh type strengthening reinforcing member 90 compensates for the brittle characteristic of the refractory material 100 increasing the effective life of the header assembly 80. For example, if the refractory material cracks the strengthening reinforcing member 90 ties the cracked pieces together and prevents separation of the header assembly 80.

Other aspects, objects and advantages will become apparent from a study of the specification, drawings and appended claims.

We claim:

1. A header assembly comprising:

a first ceramic member;

a second ceramic member being in spaced relationship to the first ceramic member;

a strengthening reinforcement member being positional in spaced relationship to the first ceramic member and the second ceramic member; and a refractory material contacting said first ceramic member, said second ceramic member and said strengthening reinforcement member and maintaining said spaced relationship.

2. The header assembly of claim 1 wherein said strengthening reinforcement member includes a mesh type configuration.

3. The header assembly of claim 2 wherein said strengthening reinforcement member surrounds the first ceramic member.

4. The header assembly of claim 3 wherein said strengthening reinforcement member has a generally rectangular configuration.

5. The header assembly of claim 4 wherein said rectangular configuration of the strengthening reinforcement member being formed from a sheet having the ends overlapping.

6. The header assembly of claim 5 wherein said ends of the strengthening reinforcement member overlap at a generally middle point of a side of the rectangular configuration.

7. The header assembly of claim 5 wherein said overlapping ends of the strengthening reinforcing member are rigidly connected.

8. The header assembly of claim 1 wherein said strengthening reinforcing member includes a plurality of fastener being attached thereto.

9. The header assembly of claim 8 wherein said plurality of fasteners are axially spaced along the strengthening reinforcing member and are off-set from adjacent ones of the plurality of fasteners.

10. The header assembly of claim 1 wherein said refractory material includes a fiber reinforcement.

11. The header assembly of claim 10 wherein said fiber reinforcement is added to said refractory material in a ratio of about 0.3 to 2 kgs of reinforcement to about every 45.4 kgs of refractory.

12. The header assembly of claim 11 wherein said fiber reinforcement added to said refractory material is in the ratio of about 1.4 kgs to 45.4 kgs respectfully.

13. The header assembly of claim 1 wherein said refractory material is a dense castable refractory material.

14. The header assembly of claim 13 wherein said refractory material comprises a blend of about 40% by weight aggregate particles and about 60% by weight fine particles.

15. The header assembly of claim 14 wherein said refractory material is a composition of 70% by weight $Al_2O_3$, 25% by weight $SiO_2$, and 5% by weight trace elements.

16. The header assembly of claim 15 wherein said mechanical connection has a strength which is dependent on said refractory material having a preestablished particle size and particle size distribution.

17. The header assembly of claim 16 wherein said refractory material comprises a blend of about 40% by weight aggregate particles and about 60% by weight fine particles.

18. The header assembly of claim 17 wherein said fine particles are defined as that portion of said refractory material passing through a sieve having a 1.0 mm opening.

19. A recuperator having a header assembly comprising:

a first ceramic member having an opening defined therein;

a second ceramic member having a tubular construction, said second ceramic member being positioned within said opening in spaced relationship thereto;

a strengthening reinforcement member being positioned in spaced relationship to the first ceramic member and the second ceramic member; and a refractory material disposed in contacting relationship with said first ceramic member, said second ceramic member and said strengthening reinforcement member.

20. The recuperator of claim 19 wherein said strengthening reinforcement member includes a mesh type configuration.

21. The recuperator of claim 20 wherein said strengthening reinforcement member surrounds the first ceramic member.

22. The recuperator of claim 21 wherein said strengthening reinforcement member has a generally rectangular configuration.

23. The recuperator of claim 22 wherein said rectangular configuration of the strengthening reinforcement member being formed from a sheet having the ends overlapping.

24. The recuperator of claim 23 wherein said ends of the strengthening reinforcement member overlap at a generally middle point of a side of the rectangular configuration.

25. The recuperator of claim 23 wherein said overlapping ends of the strengthening reinforcement member are rigidly connected.

26. The recuperator of claim 19 wherein said strengthening reinforcing member includes a plurality of fastener being attached thereto.

27. The recuperator of claim 26 wherein said plurality of fasteners are axially spaced along the strengthening reinforcing member and are off-set from adjacent ones of the plurality of fasteners.

* * * * *